US008396397B2

(12) United States Patent
Pohlt et al.

(10) Patent No.: US 8,396,397 B2
(45) Date of Patent: Mar. 12, 2013

(54) METHOD AND PRINTING APPARATUS TO PRINT A CONTINUOUS PRINTING SUBSTRATE WITH CONTROLLED LIQUID FILM QUANTITY GIVEN CHANGING PRINT SPEED

(75) Inventors: Michael Pohlt, Munich (DE); Jean Philippe Hulin, Munich (DE)

(73) Assignee: Océ Printing Systems GmbH, Poing (DE)

( * ) Notice: Subject to any disclaimer, the term of this patent is extended or adjusted under 35 U.S.C. 154(b) by 204 days.

(21) Appl. No.: 12/953,573

(22) Filed: Nov. 24, 2010

(65) Prior Publication Data

US 2011/0129264 A1 Jun. 2, 2011

(30) Foreign Application Priority Data

Dec. 1, 2009 (DE) ..... 10 2009 056 427

(51) Int. Cl.
*G03G 15/10* (2006.01)

(52) U.S. Cl. ..... 399/239

(58) Field of Classification Search ..... 399/239, 399/237, 238, 249
See application file for complete search history.

(56) References Cited

U.S. PATENT DOCUMENTS

| | | | | |
|---|---|---|---|---|
| 2002/0114650 | A1 | 8/2002 | May et al. | |
| 2004/0197116 | A1 * | 10/2004 | Yoshino et al. | 399/237 |
| 2008/0279597 | A1 | 11/2008 | Berg et al. | |
| 2009/0052948 | A1 * | 2/2009 | Ozerov | 399/239 |

FOREIGN PATENT DOCUMENTS

| | | |
|---|---|---|
| JP | 1091004 | 4/1998 |
| JP | 2004138755 | 5/2004 |
| WO | 2007057387 A1 | 5/2007 |

OTHER PUBLICATIONS

German Office Action dated Jun. 16, 2010.*

* cited by examiner

*Primary Examiner* — Walter L Lindsay, Jr.
*Assistant Examiner* — Billy J Lactaoen
(74) *Attorney, Agent, or Firm* — Schiff Hardin LLP

(57) ABSTRACT

In a method and printing apparatus to print a continuous printing substrate, a liquid film with toner and courier fluid is transported to a charge image carrier to develop charge images into toner images. Transport pairs are used comprising rotating transport members in the transport of the liquid film to the charge image carrier and from the charge image carrier to the printing substrate. Given a changing print speed of the printing apparatus at least one of the respective transport pairs is adjusted to provide a respective separation of the transport members from one another so that a substantially same quantity of the liquid film is always conveyed by the respective transport pair.

9 Claims, 3 Drawing Sheets

METHOD AND PRINTING APPARATUS TO PRINT A CONTINUOUS PRINTING SUBSTRATE WITH CONTROLLED LIQUID FILM QUANTITY GIVEN CHANGING PRINT SPEED

BACKGROUND

To print a printing substrate (made of paper, for example) it is known to generate image-dependent charge images on a charge image carrier (for example a photoconductor drum) that correspond to the images to be printed, and comprised of regions that are to be inked and regions that are not to be inked. The regions of the charge images that are to be inked can be developed with a liquid developer containing at least toner and carrier fluid. The developed images—the toner images—are subsequently transfer-printed onto the printing substrate and fixed there.

A method for such an electrophoretic liquid development in digital printing systems is known from WO2007/57387 (US 2008/279597 A1), for example. A carrier fluid containing silicon oil, hydrocarbons or vegetable oils, which carrier fluid has ink particles (toner) dispersed in it, is thereby used as a liquid developer. Among other things, a charging station, an element for graphical exposure (character generator), a developer station to develop the charge images with toner, a transfer station to transfer-print the developed charge images (the toner images) onto a printing substrate and an element to clean the photoconductor drum after the transfer-printing are arranged along a charge image carrier (for example the photoconductor drum) in the printing apparatus according to WO2007/57387.

The developer station according to WO2007/57387 has a reservoir container for the liquid developer, a chamber blade or scraper with a rotating anilox or screen roller; and a rotating developer roller. The anilox roller takes up the liquid developer of the chamber blade and transfers this to the developer roller, which directs the liquid developer past the photoconductor drum to develop the charge images into toner images. The toner images are supplied from the charge image carrier via the transfer station to the printing substrate and transfer-printed onto this. For this a rotating transfer roller can be used that accepts the toner images (embedded in carrier fluid) from the charge image carrier and supplies them to the printing substrate. In the transfer printing station the toner images are transfer-printed onto the printing substrate using an electrical field and are subsequently fixed there.

In the generation of toner images using carrier fluid and liquid developer with toner, a film made up of liquid developer is supplied to the charge image carrier. After the inking of the charge images with the liquid developer, the toner images (embedded in a film made of carrier fluid) are transfer-printed onto the printing substrate in the transfer station. In the following explanation this film made of liquid developer or carrier fluid with toner images is uniformly called liquid film.

Roller pairs with rotating rollers as transport units can be used to transfer the liquid film. The layer thickness of the transported liquid film thereby depends on, among other things, the surface velocities of the rollers of the respective roller pair and the contact pressure force of the rollers on one another. Problems arise when the surface velocities of the rollers of the roller pairs change, as this is the case when a printing device approaches its final speed. If in this case the printing of the printing substrate should already take place before reaching the final speed—thus in the start phase of the printing operation—the print images are of reduced print quality.

SUMMARY

It is an object to specify a printing apparatus operating according to the electrophoretic principle, which printing apparatus generates print images of identical print quality on the printing substrate even at different printing speeds. For example, in the start phase of the printing operation it is thereby possible to already generate print images on the printing substrate whose print quality corresponds to that of the operation at final speed. Spoilage in the start phase can be avoided in this way.

In a method and printing apparatus to print a continuous printing substrate, a liquid film with toner and carrier fluid is transported to a charge image carrier to develop charge images into toner images. Transport pairs are used comprising rotating transport members in the transport of the liquid film to the charge image carrier and from the charge image carrier to the printing substrate. Given a changing print speed of the printing apparatus at least one of the respective transport pairs is adjusted to provide a respective separation of the transport members from one another so that a substantially same quantity of the liquid film is always conveyed by the respective transport pair.

DESCRIPTION OF THE PREFERRED EMBODIMENTS

Figure 1:
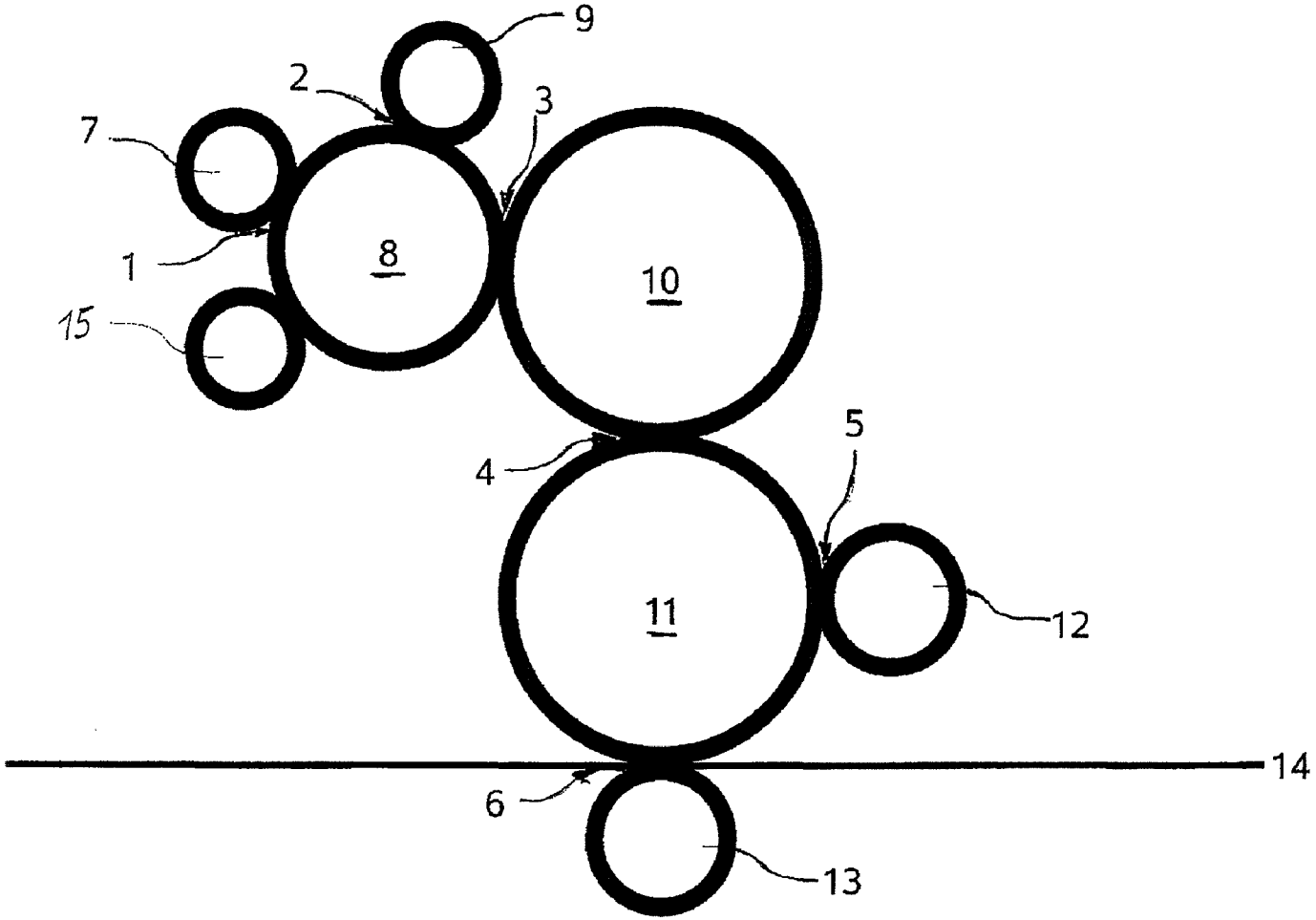
Fig. 1 (Prior Art)
FIG. 1 shows the arrangement of roller pairs to convey liquid film, for example in a printing apparatus according to the prior art—see WO 2007/57387 for explanation.

For the purposes of promoting an understanding of the principles of the invention, reference will now be made to preferred embodiments/best mode illustrated in the drawings and specific language will be used to describe the same. It will nevertheless be understood that no limitation of the scope of the invention is thereby intended, and such alterations and further modifications in the illustrated method and such further applications of the principles of the invention as illustrated as would normally occur to one skilled in the art to which the invention relates are included.

With the preferred embodiment, at different print speeds the same layer thickness of liquid film can always be moved by the respective roller pair participating in the transport process. The viscosity of the liquid film or the hardness of the rollers do not have to be altered for this. Only the contact pressure force in the roller gap (nip) between the rollers of the respective roller pair is controlled depending on the print speed so that the same quantity of liquid film arrives at the printing substrate at all printing speeds. A print quality of the print images on the printing substrate that corresponds to the print quality at the final speed of the print device can therefore already be achieved upon starting the printing apparatus, for example as of a print speed of 0.3 m/sec. Spoilage upon starting the printing apparatus is then largely avoided.

A rotating photoconductor drum 10 as a charge image carrier from an electrophoretic printing apparatus is shown in FIG. 1, to which photoconductor drum 10 a film made of liquid developer should be supplied. This liquid film is supplied by a rotating anilox roller 7 to a rotating developer roller 8 that directs the liquid film past the photoconductor drum 10 as a roller to develop charge images on the photoconductor drum 10. Depending on the charge images on the photoconductor drum 10, toner transfers from the liquid film to the photoconductor drum 10 and inks the charge images into toner images. The residual toner remaining on the developer roller 8 is cleaned off by a cleaning roller 15.

A liquid film thus is comprised of carrier fluid and toner from the anilox roller 7 via the developer roller 8 to the photoconductor 10. This liquid film is moved through nips between the roller pairs, wherein a contact pressure force that can affect the layer thickness of the liquid film is respectively exerted on the liquid film. For example, the following nips exist on the way to the photoconductor drum 10:

- a nip 1 between anilox roller 7 and developer roller 8,
- a possible nip 2 to smooth the liquid film between a smoothing roller 9 and the developer roller 8 (insofar as a smoothing roller 9 is used),
- a nip 3 between the developer roller 8 and the photoconductor drum 10 as a roller.

The liquid film with the developed toner images is subsequently supplied via a transfer station to the continuous printing substrate 14 and transfer-printed onto this. The transfer station in turn has rollers that interact as roller pairs in order to convey the liquid film for transfer-printing. For example, the following roller pairs can form a nip:

- a nip 4 between the photoconductor drum 10 as a roller and a transfer roller 11 that accepts the liquid film from the photoconductor drum 10,
- a possible nip 5 between the transfer roller 11 and a roller 12 via which the liquid film is prepared for the transfer onto the printing substrate 14,
- a nip 6 between the transfer roller 11 and a contact pressure roller 13 that presses the printing substrate 14 onto the transfer roller 11.

In all of these nips 1 through 6 contact pressure forces are exerted on the liquid film that affect the quantity of transported liquid. In particular in the start phase of the printing process, when the rollers 6 through 13 and the printing substrate 14 have been accelerated this has previously led to the situation that the quantity of transported liquid film—and therefore the print quality of the print images on the printing substrate 14—changed significantly. If the print speed is selected to be low and the contact pressure too high, this moreover leads to print quality disruptions due to developer film backpressure before the roller pair.

In order to always ensure a uniform print quality at different print speeds (and therefore different velocities of the rollers 7 through 13 and the printing substrate 14, the size of the nips 1 through 6 of the roller pairs conveying the liquid film is now controlled depending on the print speed so that the quantity of liquid film that is also required at the final speed of the printing operation is always transported through the nips 1 through 6. The print images are therefore always inked the same on the print data stream 14, even if the print speed has not yet reached the final speed.

Figure 2:
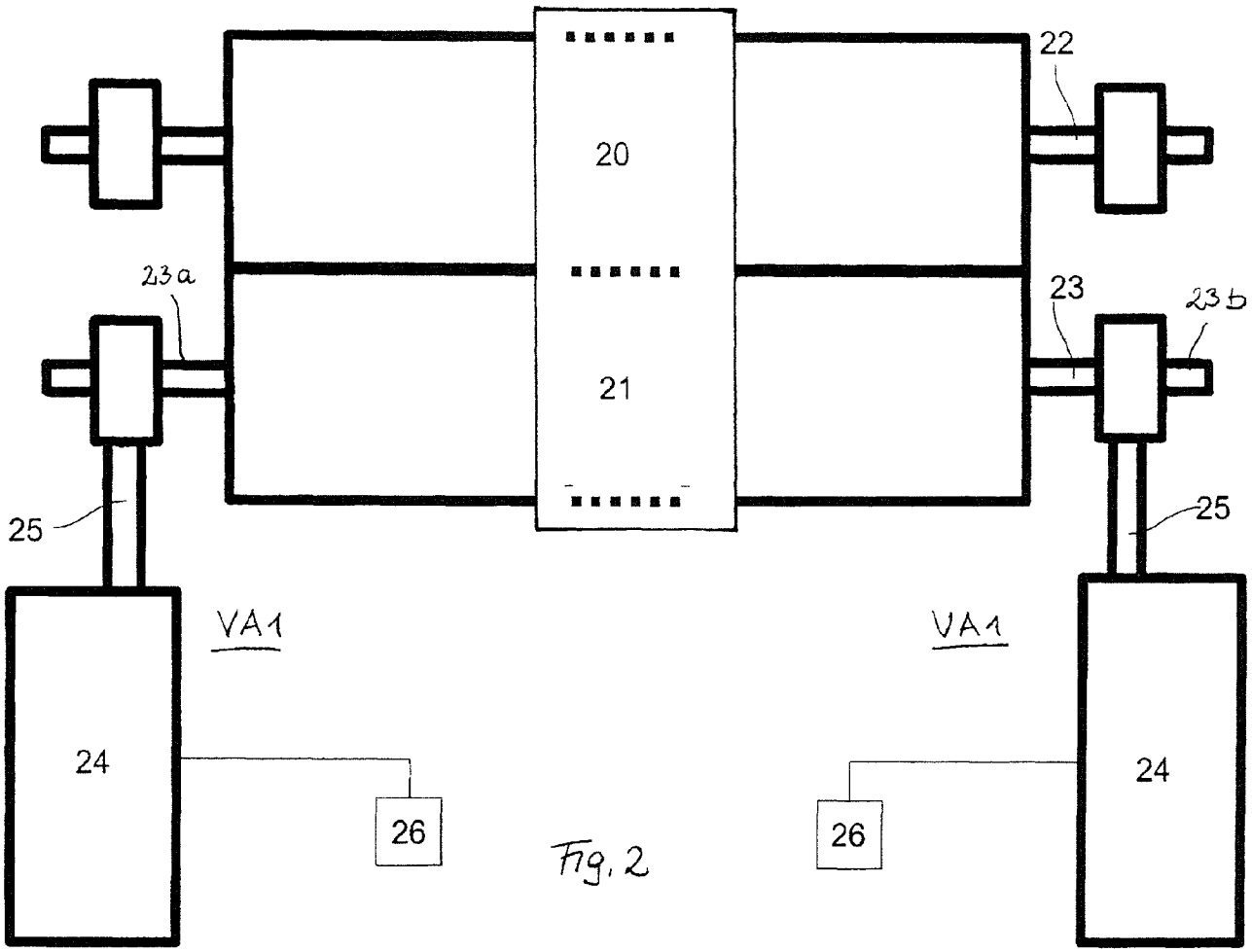
FIG. 2 illustrates a first arrangement to adjust the separation of the rollers of a roller pair used to convey the liquid film.
Figure 3:
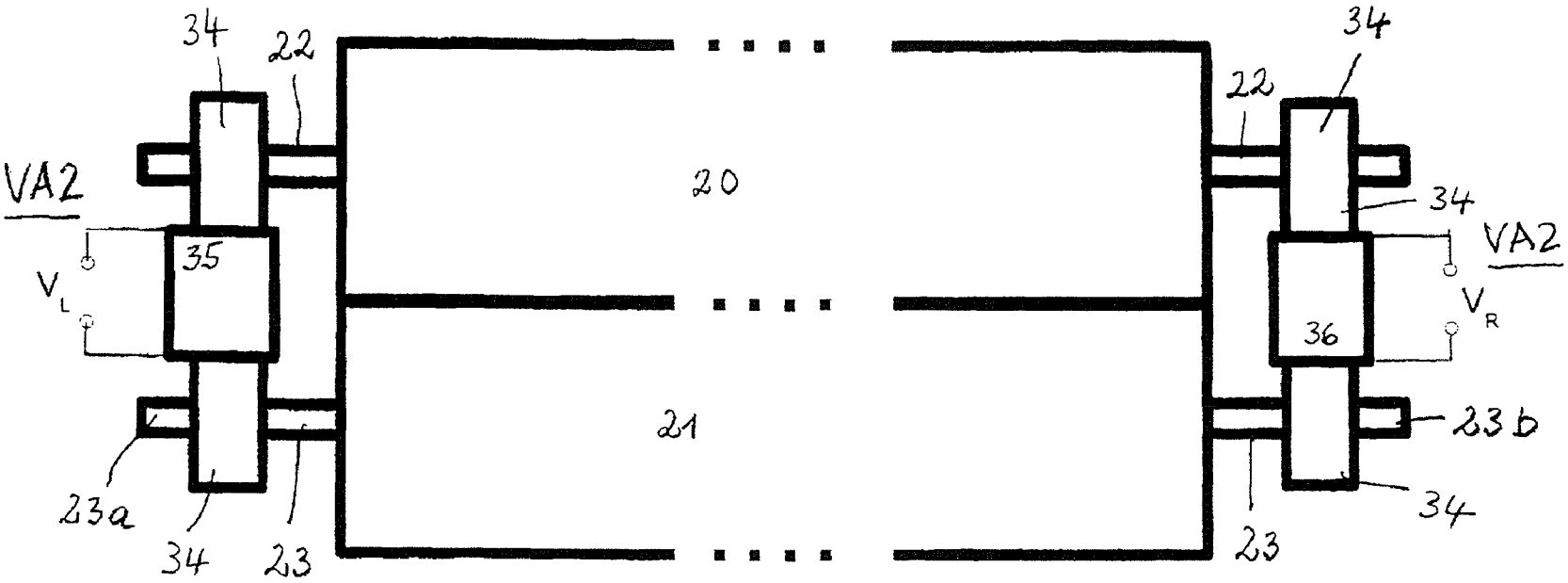
FIG. 3 illustrates a second arrangement to adjust the separation of the rollers of a roller pair used to convey the liquid film.

Examples of arrangements with which the roller intervals in the nips 1, 2, 3, 4, 5,6 can be adjusted result from FIGS. 2 and 3.

A first embodiment in which the distance between two rollers 20, 21 that are borne on axles 22, 23 should be adjusted arises from FIG. 2. The one roller 20 is thereby borne to be stationary while the other roller 21 can be shifted in the direction towards roller 20. To shift the roller 21, a displacement unit 1 made of a pressure cylinder 24, a piston 25 and a control unit 26 is respectively used on both sides. The displacement unit arrangement VA1 has a pressure cylinder 24 that can thus be varied so that the piston 25 moves the roller 21 towards the roller 20 or away from this. The contact pressure for the roller 21 can thereby be variably adjusted for different speeds by means of the electronic control unit 26. The desired values for the contact pressures can, for example, be taken from a table stored in the printer controller; in which table the desired values for the pressures in the pressure cylinders 24 are listed depending on the print speed. For example, these values can be determined via measurements. The real values of the pressures in the pressure cylinders 24 (which are a measurement of the contact pressures of the rollers 22, 23 of the roller pair) can be determined via measurement. Deviations can be established by comparing the desired values with the real values, and the pressure in the pressure cylinders 24 can be corrected to the respective desired value depending on the deviations.

A second embodiment of a displacement arrangement VA2 for the roller 20, 21 results from FIG. 3. Respective linear actuators—for example piezocrystals 35, 36—that affect the respective axles 22, 23 via coupling pieces, such as spacers or; adapters 34, are respectively arranged between the axles 22, 23 of the rollers 20, 21. By applying a corresponding voltage $V_L$, $V_R$ to the piezocrystals 35, 36, the expansion of the piezocrystals 35, 36 can be varied depending on the print speed and the expansion of the piezocrystals 35, 36 can therefore be controlled so that the separation of the two rollers 20, 21 is adjusted corresponding to the print speed. If the print speed is still low in comparison to the final speed of the printing apparatus, the piezocrystals 35, 36 are set to such a voltage $V_L$, $V_R$ that these expand, and therefore the distance of the rollers 20, 21 from one another increases. If the print speed is increased, the voltage $V_L$, $V_R$ is varied so that the piezocrystals 35, 36 contract and the rollers 20, 21 approach one another. The desired values for the voltages $V_L$, $V_R$ can in turn be learned from a table stored in the printer controller, in which table the desired values are listed depending on the print speed. These values can be determined via measurements, for example.

In FIGS. 2 and 3 displacement units VA1, VA2 are used for both axle ends 23.1 and 23.2 of the axle 23 for the roller 21. However, it is also possible to use only one displacement unit VA1, VA2 for one axle end—for example the axle end 23.1—if the other end—for example axle end 23.2—of the axle is directed accordingly.

A third embodiment of a displacement arrangement for the rollers can provide a step motor (not shown in the drawing Figures). The axles, and therefore the rollers, are driven from a pivoted-away state into operating position at the final speed of the printing apparatus. The number of steps and the step size establishes the separation of the rollers of the roller pairs. Given a change of the print speed, the controller of the printing apparatus can adjust the roller separation with an adapted number of steps of the step motor so that the quantity of liquid film that is conveyed by the roller pairs remains constant.

The displacement units VA according to the exemplary embodiments can be used for all roller pairs involved in the transport of the liquid film. It is therefore ensured that the conveyed quantity of liquid film to the printing substrate is kept constant, independent of the print speed.

Rollers have been used to transport the liquid film in FIGS. 2 and 3. However, it is also possible to use belts instead of individual rollers.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to print a continuous printing substrate with an electrophoretic printing apparatus, comprising the steps of:

transporting a liquid film with toner and carrier fluid to a charge image carrier to develop charge images on said charge image carrier into toner images, and in which the toner images in the liquid film are transfer-printed onto the printing substrate;

using transport pairs comprising rotating transport members in the transport of the liquid film to the charge image carrier and from the charge image carrier to the printing substrate; and given a changing print speed of the printing apparatus, for every transport pair adjusting a respective separation of the transport members from one another so that a substantially same quantity of the liquid film is always conveyed by the respective transport pair, and wherein a desired value for the separation of the transport members of the respective transport pairs from one another is stored in a table depending on the print speed, a real value of the separation of the transport members of the respective transport pairs from one another being measured, the real value being compared with the desired value, and the separation of the transport members of the respective transport pair being modified to the desired value given deviation of the real value from the desired value.

2. The method according to claim 1 in which belts are used as at least some of said transport members to transport the liquid film.

3. A method to print a continuous printing substrate with an electrophoretic printing apparatus, comprising the steps of:

transporting a liquid film with toner and carrier fluid to a charge image carrier to develop charge images on said charge image carrier into toner images, and in which the toner images in the liquid film are transfer-printed onto the printing substrate;

using transport pairs comprising rotating transport members in the transport of the liquid film to the charge image carrier and from the charge image carrier to the printing substrate;

given a changing print speed of the printing apparatus, for every transport pair adjusting a respective separation of the transport members from one another so that a substantially same quantity of the liquid film is always conveyed by the respective transport pair; and at least the following transport pairs comprising roller pairs being used to transport the liquid film to the printing substrate an anilox roller and a developer roller to convey the liquid film to the developer roller, the developer roller and a photoconductor drum as a roller to convey the liquid film past the photoconductor drum, and the photoconductor drum and a transfer roller to convey the liquid film containing the toner images to the printing substrate.

4. The method according to claim 3 wherein at least one roller of a respective roller pair is borne such that it can be displaced relative to the other roller of the roller pair, and wherein a displacement unit that adjusts the separation of the rollers of the roller pair depending on the print speed is associated with the one of the rollers of the roller pair.

5. The method according to claim 4 wherein the displacement unit comprises a pressure cylinder, a piston actuated by the pressure cylinder and coupled with an axle of the one roller, and a control unit adjusting a pressure in the pressure cylinder, wherein the control unit adjusts the pressure in the pressure cylinder depending on the print speed.

6. The method according to claim 4 wherein said displacement unit comprises a linear actuator arranged between the rollers and to which an electrical voltage is applied, the voltage being varied depending on the print speed.

7. The method according to claim 6 wherein a piezocrystal is provided as said linear actuator.

8. The method according to claim 4 wherein said displacement unit comprises a step motor, a step count and a step size of which are varied depending on the print speed, said step motor being coupled with the one roller of the roller pair.

9. The method according to claim 4 in which two of said displacement units are provided, a first arranged at one side of an axle of one of the rollers to be displaced, and the other displacement unit being arranged at an opposite side of the axle of the other roller to be displaced.

* * * * *